US005711256A

United States Patent [19]

Brandon

[11] Patent Number: 5,711,256

[45] Date of Patent: Jan. 27, 1998

[54] APPARATUS FOR MASKING COMPONENTS OF A HOT WATER TANK FROM INSULATION

[76] Inventor: Bob C. Brandon, 5883 Hwy. 69 South, Columbus, Miss. 39702

[21] Appl. No.: 763,546

[22] Filed: Dec. 10, 1996

[51] Int. Cl.[6] ..... F22B 5/00

[52] U.S. Cl. ..... 122/13.1; 126/361; 264/45.2; 264/46.9; 264/314

[58] Field of Search ..... 264/45.2, 46.9, 264/276, 46.5, 314; 122/13.1, 13.2, 14, 15, 16, 17, 18, 19; 126/36, 362, 363

[56] References Cited

U.S. PATENT DOCUMENTS

| | | | |
|---|---|---|---|
| 4,477,399 | 10/1984 | Tilton | 264/46.9 |
| 4,632,792 | 12/1986 | Clark | 264/46.9 |
| 4,808,356 | 2/1989 | West et al. | 264/46.9 |
| 5,000,893 | 3/1991 | West et al. | 264/46.9 |
| 5,052,346 | 10/1991 | Beck | 264/46.9 |
| 5,117,810 | 6/1992 | Threatt | 126/361 |
| 5,213,728 | 5/1993 | Hickman | 264/46.9 |
| 5,263,469 | 11/1993 | Hickman | 126/361 |

*Primary Examiner*—Allan R. Kuhns
*Attorney, Agent, or Firm*—Brady, O'Boyle & Gates

[57] ABSTRACT

A method and apparatus for masking components of a hot water tank from insulation wherein a carrier sheet containing a pair of inflatable rings is insertable into the space between the inner tank and outer shell of the hot water tank. The inflatable rings surround electrical components on the inner tank to prevent insulation injected into the space from covering the electrical components. Inflatable bags are insertable into threaded bores on fittings connected to the inner tank to prevent the insulation from covering the threaded bores, and to prevent insulation from escaping to the outside of the outer shell.

2 Claims, 3 Drawing Sheets

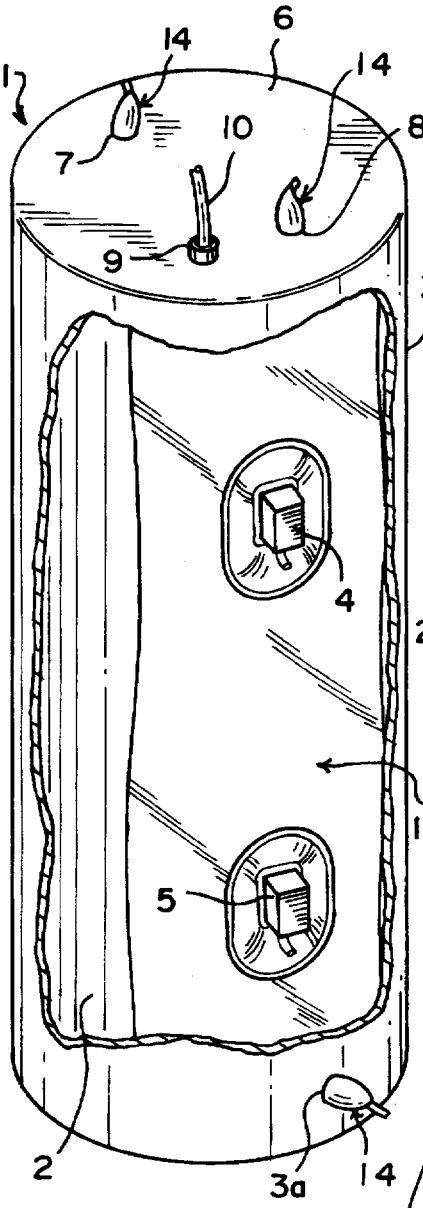
FIG. 6
FIG. 7
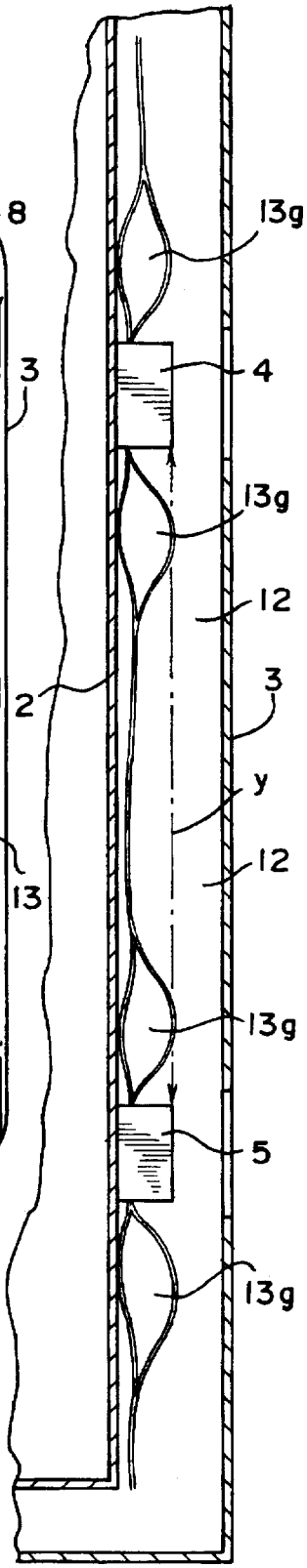
FIG. 8
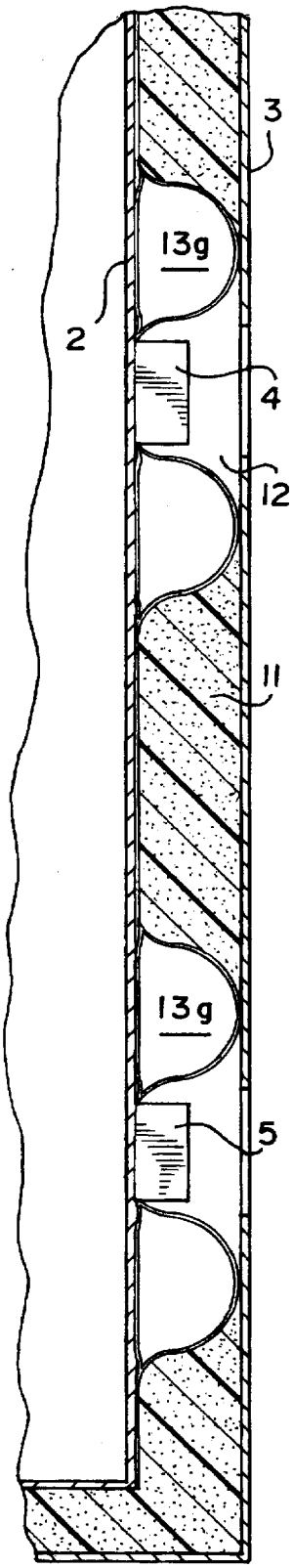

APPARATUS FOR MASKING COMPONENTS OF A HOT WATER TANK FROM INSULATION

BACKGROUND OF THE INVENTION

In U.S. Pat. No. 4,477,399 dated Oct. 16, 1984, there is disclosed a plurality of inflatable annular tubes employed for masking the wiring and electrical devices in an electric water heater to prevent foamed insulation material, injected between the inner tank and outer shell, from coming into contact with the electrical devices associated with the heater.

While this masking arrangement has been satisfactory for its intended purpose, it has been characterized by certain disadvantages in that each inflatable annular tube has to be mounted individually around the electrical devices, thus, increasing the time required to mask the electrical devices before the injection of the insulation, and there is no provision for masking the fittings having threaded bores on the inner tank to prevent the insulation from contacting the bore threads to which the various nipples for the cold and hot water lines, and drain valve, are threaded.

SUMMARY OF THE INVENTION

To overcome the disadvantages experienced in the prior art masking arrangement, the masking arrangement of the present invention has been devised which comprises, essentially, a carrier sheet having a plurality of spaced inflatable, annular rings integral therewith. The space between the rings corresponds to the distance between the electrical components on a hot water tank, whereby the sheet and associated inflatable rings are placed as a unit between the inner tank and outer shell and the rings are inflated to expand in the space between the inner tank and outer shell, to thereby mask the electrical components from the insulation injected into the space between the inner tank and outer shell. By this construction and arrangement, the inflatable rings are simultaneously installed around the electrical components when the carrier sheet is placed in the space between the inner tank and outer shell.

Inflatable bags or tubes are also inserted into fittings having threaded bores provided in the inner tank wall to mask the bore threads from the insulation, and to keep insulation from escaping to the outside of the outer shell.

BRIEF DESCRIPTION OF THE DRAWINGS

FIG. 6 is a perspective view of an electric domestic hot water tank showing the carrier sheet and associated inflatable rings in the masking position around the electrical components and the inflatable tube in the masking position for the pipe fittings.

FIG. 7 is a fragmentary, sectional side elevational view of the hot water tank and the carrier sheet illustrating the ring before inflation;

FIG. 8 is a fragmentary, sectional, side elevational view of the hot water tank and carrier sheet illustrating the inflated rings masking the tank electrical components from the insulation injected between the inner tank and outer shell;

DESCRIPTION OF THE PREFERRED EMBODIMENTS

Figure 1:
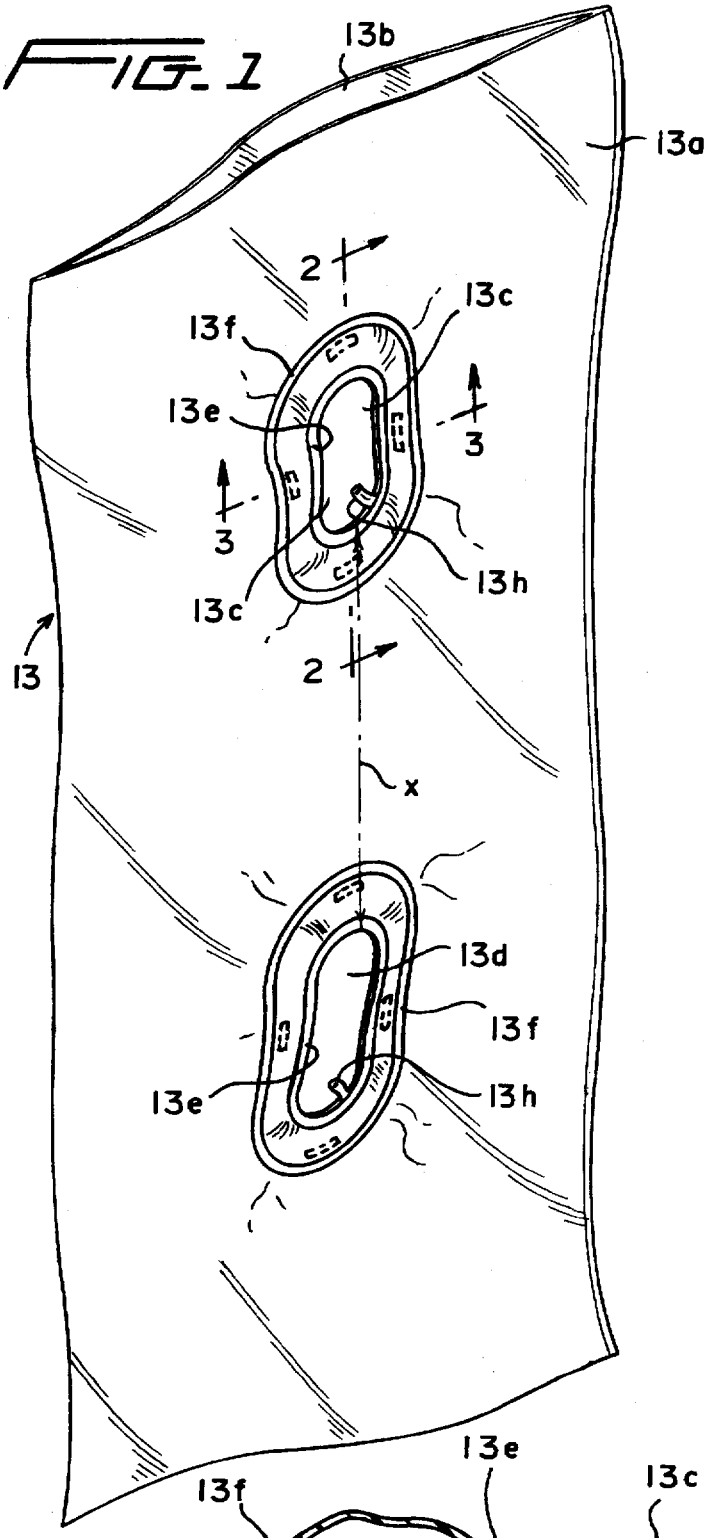
FIG. 1 is a perspective view of a carrier sheet having a pair of vertically spaced, inflatable annular rings integral therewith.

Referring to the drawings and, more particularly to FIG. 6, a conventional domestic electric hot water heater 1 is shown having an inner tank 2 and an outwardly spaced shell 3. A pair of vertically spaced electrical components, such as thermostats 4 and 5 are connected to the wall of inner tank 2. The top wall 6 of the outer shell 3 is provided with openings 7 and 8 through which the hot and cold water lines (not shown) extend to the inner tank 2. Another opening 9 is also provided in the top wall 6 through which a vent line (not shown) to the inner tank 2 extends, and an opening 3a is provided in the outer shell 3 through which a drain line (not shown) to the tank 2 extends.

During the manufacture of this tank, a tube 10 is inserted through the opening 9 in the top wall 6 of the tank, and foamed insulation material 11, FIG. 8, is injected into the space 12 between the inner tank 2 and outer shell 3. In order to prevent the insulation material from covering the electrical components 4 and 5, a masking device 13 is provided.

Figure 2:
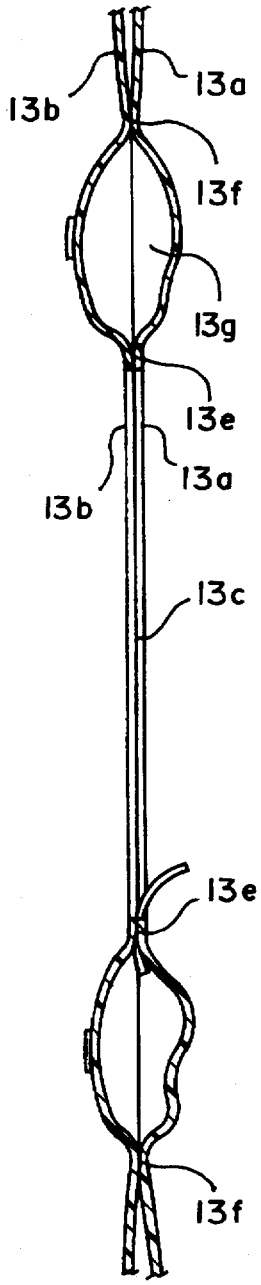
FIG. 2 is a view taken along line 2—2 of FIG. 1.
Figure 3:
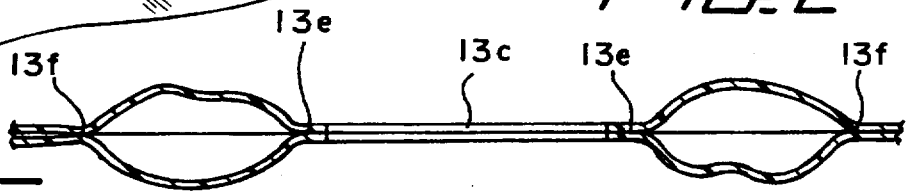
FIG. 3 is a view taken along line 3—3 of FIG. 1.

The details of the masking device 13 are illustrated in FIGS. 1 to 3, which comprise a laminate plastic sheet having a pair of layers 13*a* and 13*b*. A pair of openings 13*c* and 13*d* are cut through the laminate sheet, and the portions of the layers 13*a* and 13*b* extending around the peripheral edge of the openings 13*c* and 13*d* are welded as at 13*e*. The pair of layers 13*a* and 13*b* are also secured together as at 13*f* by a peripheral weld spaced radially outwardly from the first peripheral weld 13*e*, whereby an inflatable ring 13*g* is formed adapted to be inflated through a tube 13*h*. The openings 13*c* and 13*d* are vertically spaced from each other and the distance "x" between the openings 13*c* and 13*d* corresponds to the distance "y" on the electrical components 4 and 5 on the hot water tank 1.

In use, the masking device 13 is inserted into the space 12 between the inner tank 2 and outer shell 3 of the hot water heater, as shown in FIG. 7, and the rings 13*g* are inflated, as shown in FIG. 8, to mask the portion of the space 12 around the electrical components 4 and 5 to prevent the foamed insulation 11 from covering the components. By the construction and arrangement of the plastic laminate sheet and the spacing of the inflatable rings thereon, the sheet functions as a carrier for the inflatable rings 13*g* which are spaced from each other a distance "x" corresponding to the distance "y" between the components 4 and 5 so that the rings can be installed as a unit rather than individually. After the insulation 11 has solidified, the rings 13*g* can be deflated, and another form of insulation insert can be placed in the area around the electrical devices if needed.

Figure 4:
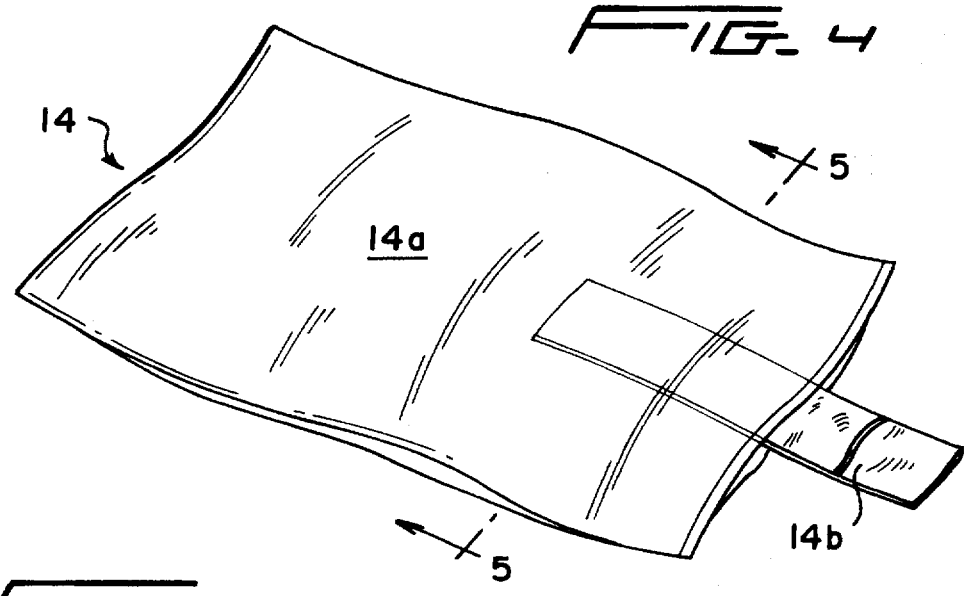
FIG. 4 is a perspective view of an inflatable tube.
Figure 5:
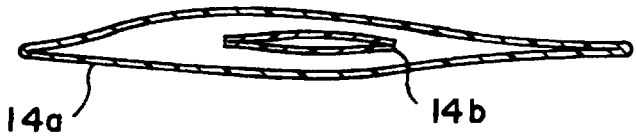
FIG. 5 is a view taken along line 5—5 of FIG. 4.
Figure 9:
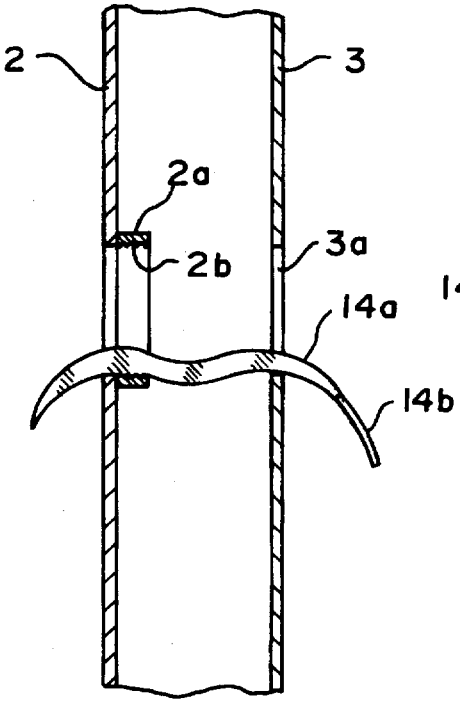
FIG. 9 is a fragmentary, side elevational view partly in section of the hot water tank wall illustrating the deflated tube positioned in a threaded bore in the inner tank wall and extending outwardly of an opening in the outer shell.

As will be seen in FIG. 6, another masking device 14 is provided for masking the threaded bore fittings in the inner tank 2 to which the hot and cold water lines and drain line are connected and for preventing insulation from escaping to the outside of the outer shell 3. The details of the construction of the masking device 14 are shown in FIGS. 4 and 5 and comprises a closed cylindrical, plastic bag 14*a* having an integral inflation tube 14*b* extending through one end thereof.

Figure 10:
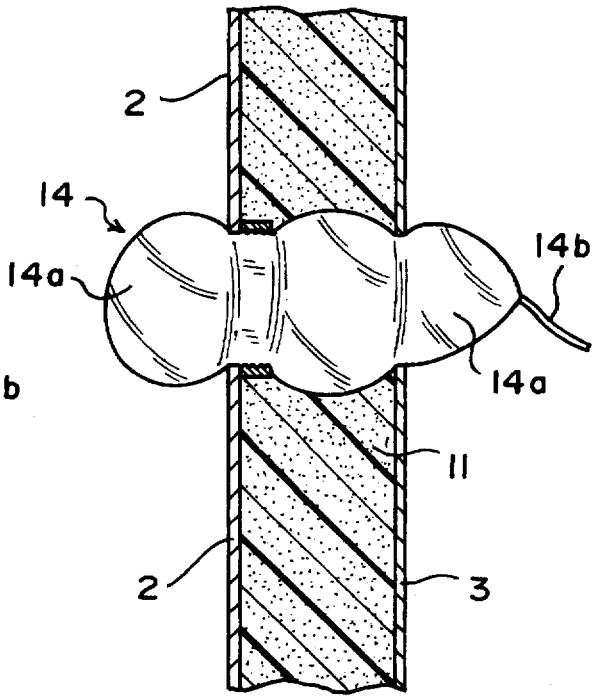
FIG. 10 is a view similar to FIG. 9 but showing the tube inflated to mask the threads on the bore from insulation injected into the space between the tank and outer shell.

In use, the bag 14*a* is inserted through the opening 3*a* in the outer sheet 3 and through a fitting 2*a*, integral with the inner tank 2, and having a threaded bore 2*b*. The bag 14 is inflated as shown in FIG. 10 to mask the threaded bore 2*b* from the insulation 10. While the masking device 14 has been described for use in the drain opening 3*a*, it will be understood that it will be used in the same manner for the threaded bore fittings to which the hot and cold water lines are connected which extend through the openings 7 and 8 in the top wall 6 of the outer shell. After the insulation 11 has set, the bags 14*a* are deflated and removed from their respective openings.

From the above description, it will be readily apparent to those skilled in the art that the masking devices 13 and 14 of the present invention provide an improved arrangement for not only masking the electrical components of an electric hot water heater from the insulation injected into the space between the inner tank and outer shell, but also for masking the threaded bores on the inner tank.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

I claim:

1. In combination, a hot water heater having an inner tank and an outer shell spaced from the inner tank, at least one fitting mounted on the inner tank, said fitting having a threaded bore, an opening in the outer shell aligned with said threaded bore, and a masking device inserted through said opening and into said threaded bore, and foamed insulation injected into the space between the inner tank and outer shell, whereby the masking device prevents the insulation from covering the threaded bore and escaping to the outside of the outer shell.

2. The combination of claim 1, wherein the masking device comprises an inflatable bag.

* * * * *